US012466589B2

(12) United States Patent
Boje et al.

(10) Patent No.: US 12,466,589 B2
(45) Date of Patent: Nov. 11, 2025

(54) VALVE BAG FILLING DEVICE

(71) Applicant: Greif-Velox Maschinenfabrik GmbH, Lübeck (DE)

(72) Inventors: Alexander Boje, Lübeck (DE); Bernd Tillack, Lübeck (DE); Ralf Drews, Lübeck (DE); Alexander Mildner, Lübeck (DE)

(73) Assignee: Greif-Velox Maschinenfabrik GmbH, Lübeck (DE)

( * ) Notice: Subject to any disclaimer, the term of this patent is extended or adjusted under 35 U.S.C. 154(b) by 215 days.

(21) Appl. No.: 18/338,420

(22) Filed: Jun. 21, 2023

(65) Prior Publication Data

US 2023/0415930 A1 Dec. 28, 2023

(30) Foreign Application Priority Data

Jun. 22, 2022 (EP) ..... 22180479

(51) Int. Cl.
*B65B 1/18* (2006.01)
*B65B 1/16* (2006.01)

(52) U.S. Cl.
CPC . *B65B 1/18* (2013.01); *B65B 1/16* (2013.01)

(58) Field of Classification Search
CPC ..... B65B 1/18; B65B 1/16; B65B 31/024; B65B 2210/08
See application file for complete search history.

(56) References Cited

U.S. PATENT DOCUMENTS 4,219,054 A * 8/1980 Carter ..... B65B 7/025 141/10
4,567,922 A * 2/1986 Lepisto ..... B65B 1/18 141/10
4,576,210 A * 3/1986 Lepisto ..... B65B 1/18 141/115

FOREIGN PATENT DOCUMENTS

DE 584956 C 10/1933
DE 3834810 A1 4/1990
DE 102006021850 A1 11/2007
DE 202018006418 U1 5/2020

OTHER PUBLICATIONS

Translation of DE 38 34 810 (Year: 1990).*

* cited by examiner

*Primary Examiner* — Jason K Niesz
(74) *Attorney, Agent, or Firm* — McGlew and Tuttle, P.C.

(57) ABSTRACT

A valve bag filling device for filling powdered filling material into a valve bag is provided, and has a filling spout (1), which is provided so as to be introduced into a valve hose of a valve bag to be filled. The device has a conveying device for conveying the filling material to be filled from a supply tank through the filling spout (1) into a valve bag resting on the filling spout (1) with the valve hose, as well as a suction device (3, 4) for aspirating excess filling material via a suction opening (5). The suction opening (5) is arranged spaced a distance (9, 10) from the filling spout (1). A control device is provided, with which the suction opening (5) can be traversed in a direction (6) in relation to the filling spout (1).

20 Claims, 3 Drawing Sheets

1
2
2a
2b
3
4
5
6
7
8
9
10

VALVE BAG FILLING DEVICE

CROSS REFERENCE TO RELATED APPLICATIONS

This application claims the benefit of priority under 35 U.S.C. § 119 of European Application 22180479.2, filed Jun. 22, 2022, the entire contents of which are incorporated herein by reference.

TECHNICAL FIELD

The invention relates to a valve bag filling device for filling powdered filling material into a valve bag.

BACKGROUND

Numerous embodiment variants of such valve bag filling devices constitute part of prior art. They typically have a filling spout, which is provided so as to be introduced into a valve hose of a valve bag to be filled, and a conveying device, with which the filling material to be filled is conveyed from a supply tank through the filling spout into a valve bag resting on the filling spout with the valve hose. It here constitutes part of prior art that a suction device for aspirating excess filling material be provided, which has a suction opening arranged spaced apart from the filling spout. Such a suction device is provided for aspirating the filling material that gets into the ambient air during the filling process.

For example, a valve bag filling device is known from DE 20 2018 006 418 U1. This valve bag filling device involves a vacuum filling device, in which the valve bag is arranged inside of a vacuum chamber, and the filling process essentially takes place via a negative pressure in the chamber. In this way, not just the gas carried along with the filling material, in particular air, gets into the suction device, but also excess filling material, if the valve bag is defective or is not tightly arranged on the filling spout. A dust sensor detects this and aborts the filling process.

The suction device operating in conjunction with the vacuum chamber is only active during the filling process, and inactive with the vacuum chamber open.

SUMMARY

The suction device operating in conjunction with the vacuum chamber is only active during the filling process, and inactive with the vacuum chamber open.

The object of the present invention is to design a valve bag filling device of the kind mentioned at the outset in such a way that it can be used to remove excess filling material after filling, even during a filling process as intended. This is necessary in particular for filling material such as graphite dust, color pigments and the like, in which case filling material residue would negatively affect the subsequent filling process or the exterior of a valve bag.

This object is achieved by a valve bag filling device with features according to the invention, while advantageous embodiments of the invention are indicated herein including in the following description and the drawing.

The valve bag filling device according to the invention is intended and configured for filling powdered filling material into a valve bag. It has a filling spout provided so as to be introduced into a valve hose of a valve bag to be filled, as well as a conveying device, with which the filling material to be filled is conveyed from a supply tank through the filling spout into a valve bag resting on the filling spout with the valve hose. A suction device for aspirating excess filling material is provided, which has a suction opening arranged spaced a distance from the filling spout. According to the invention, a control device is provided, with which the suction opening can be traversed in relation to the filling spout.

As a consequence, the basic idea of the inventive solution is to traversibly arrange the suction opening of the suction device by means of a control device, so that the suction opening can be traversed (moved) in relation to the filling spout. The advantage to this traversibility is on the one hand that a sufficiently large distance between the suction opening and filling spout can be approached so as to not impede the equipping of the device with the valve, the filling process and the removal of the filled valve set from the device, and on the other hand to be able to traverse the suction opening close enough to the filling spout to enable the reliable aspiration of any excess filling material located there, which typically remains behind on the filling spout after concluding the filling process and removing the valve bag. The inventive configuration of the valve bag filling device is not limited to those devices that fill by means of a vacuum chamber, but instead can also find application for valve bag filling devices with pressure filling or combined suction pressure filling.

It is especially advantageous if the control device has an actuator, with which the suction opening can be traversed from a position close to the spout to one remote from the spout and vice versa. For example, such an actuator can be electric or pneumatic, expediently adjusted to the drive present for the respective valve bag filling device. If the objective is for the traversibility of the suction opening to be as product-adjusted as possible, the actuator can have a manipulator, for example which can move the suction opening not just to a position near the spout, but rather to a plurality of locations near the spout, e.g., guide the suction opening at the end of a suction hose helically around the end of the filling spout, so as to aspirate it as completely as possible.

It is especially advantageous if the control device has a controller with which the desired position of the suction opening can be controlled, wherein this controller advantageously comprises part of the machine controller of the valve bag filling device, or is at least signal-connected with it, so as to integrate the aspiration into automated filling processes. The controller is here advantageously configured in such a way that the position close to the spout is only approached after the valve hose has been removed from the filling spout or already once the filling process has ended. In the latter case, in particular the filling material loosened from the filling spout while pulling off the valve hose can be aspirated, while in the former case, primarily an aspiration of the filling spout itself is provided.

The inventive configuration can be used especially advantageously in a valve bag vacuum filling device with a vacuum chamber, wherein the suction opening is arranged outside of the vacuum chamber in the position remote from the spout, and inside, i.e., in the area of the opened vacuum chamber, in the position close to the spout. The ability of the suction opening to traverse from one position remote from the spout outside of the vacuum chamber into a position close to the spout inside of the open vacuum chamber makes it possible to retrofit the suction device even on existing valve bag vacuum filling devices, since the valve chamber is not influenced by the suction device during the actual aspirating process, but can be aspirated with regard to any filling material portions on the filling spout after the valve chamber has been opened, in particular after the valve bag has been removed from the valve chamber. The vacuum chamber typically consists of two chamber halves, with the filling spout being located centrally between them, which are moved apart to plug on the valve bag and to remove the filled valve bag. In this moved apart position, the suction opening is advantageously traversed into the open vacuum chamber in the position near the spout, so as to approach the filling spout as closely as possible with the suction opening, and thereby enable as complete an aspiration of any excess filling material that might be located there.

Since excess filling material not only rests on the upper side of the filling spout while removing the valve bag from the filling spout, but can also adhere to any location, it is advantageous that the aspiration be performed as completely as possible. According to a further development of the invention, the suction opening to this end has an annular configuration in its position close to the spout, so that it can extend around a section of the filling spout, and completely aspirate the latter.

According to a further development of the invention, the suction device can advantageously operate not just by means of a negative pressure, but rather be equipped with blowing nozzles that are connected with a pressurized gas line. These types of blowing nozzles are advantageously arranged before the suction opening inside of the suction line, specifically in such a way as to have as directed an airflow as possible onto the filling spout, so that the filling material adhering there is loosened by the airflow, and subsequently aspirated into the suction line through the suction opening.

In order to achieve as complete an aspiration of the filling spout as possible, an annular suction opening can be guided around the filling spout, e.g., by means of a manipulator along the latter. However, it is significantly easier in terms of design and control, and can advantageously be provided according to the invention, that an annular suction be formed by an annular housing that is open toward the filling spout, and has at least one movable or foldable housing part, which makes it possible to guide this housing radially over the filling spout with the housing part folded down, and subsequently form a suction opening that surrounds the filling spout by moving or folding down this at least one housing part. According to a further development of the invention, two foldable housing parts are preferably provided, e.g., which in their folded down position arrange the lower annular housing part that extends by about 180 degrees in such a way that it can be traversed radially to the filling spout, e.g., upwardly to be transferred from the position remote from the spout to the one close to the spout and vice versa. Alternatively, the at least one foldable or movable housing part in the position close to the spout could also be arranged above the filling spout.

According to a further development of the invention, a constructively simple while still effective configuration of the suction line has a suction nozzle arranged on an end side, which forms the upper half of an annular housing open toward the filling spout, wherein the lower half of this housing is formed by at least one, preferably two lower housing parts or housing sections, which are arranged next to the suction nozzle in the opened position, and under the latter in a closed position. A reversed arrangement would alternatively also be possible, in which the suction nozzle is arranged below and the at least one movable housing part above. Such an arrangement would be configured inversely to the following description. The opened position in which the at least one housing section or the housing sections are arranged next to the suction nozzle is provided in order to traverse from the position remote from the spout to the one close to the spout, until the upper housing half of the annular housing surrounds an upper section of the filling spout. In this position, the at least one lower movable housing part or the lower housing sections can then advantageously be folded up, so as to in this way form a suction opening that annularly surrounds the filling spout. Aspiration thus takes place in a closed position, whereas the open position is provided for traversing purposes. In this configuration, a controller is advantageously provided, which traverses the at least one lower or the lower housing sections upon reaching the position close to the filling spout to include the filling spout under the suction nozzles, and traverses them back to the opened position again after aspiration, so that traversal into the position remote from the filling spout can take place. Preferably present for this purpose is at least one drive coupled with the at least one movable housing part for moving the latter and/or a mechanism that moves the housing part(s). The controller is advantageously automated, and integrated into the machine controller, or at least signal-connected with the latter.

The invention will be explained in more detail below based on an exemplary embodiment. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figures 1A, 1B:
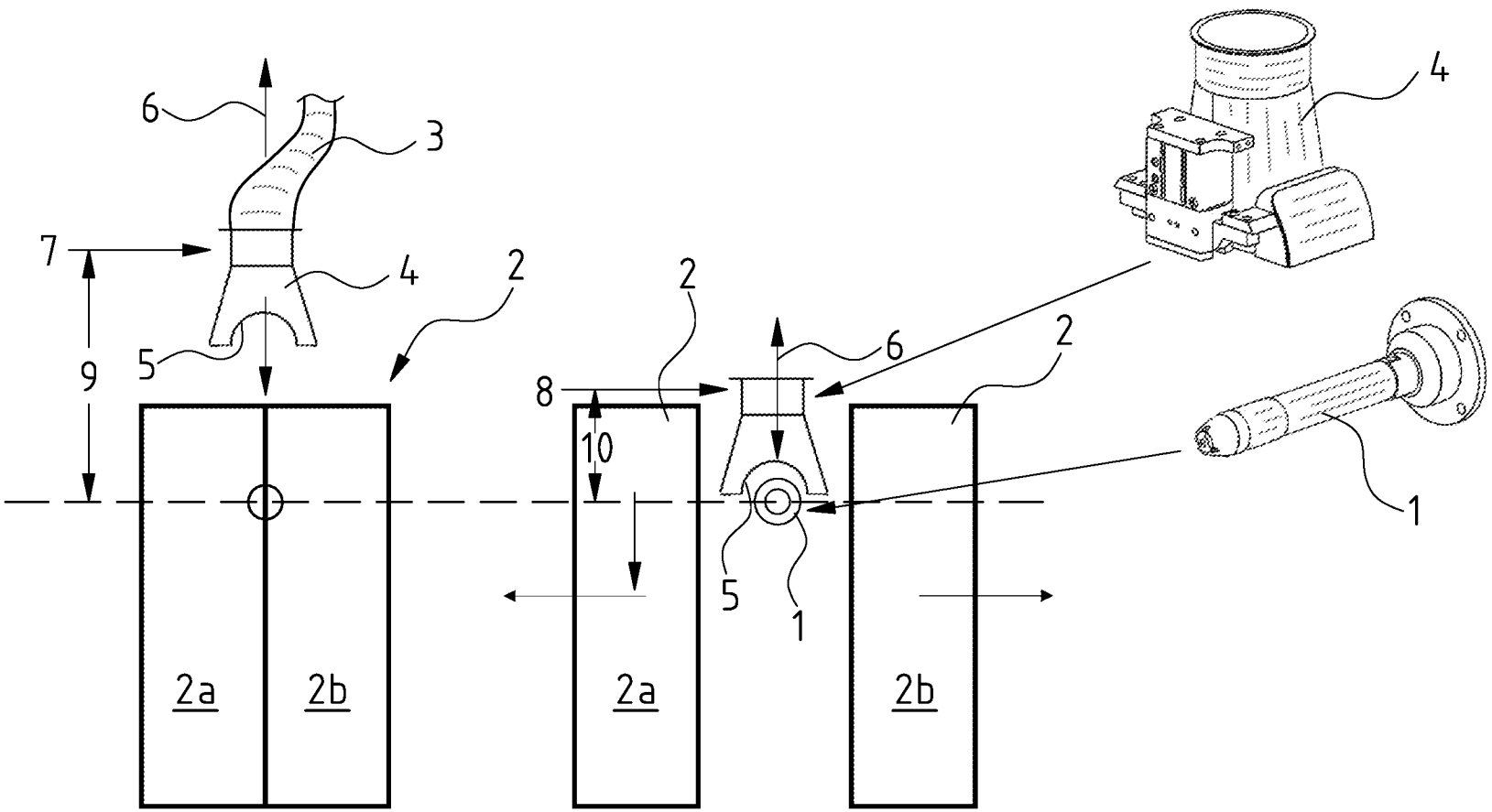
FIG. 1*a* and FIG. 1*b* are highly simplified schematic views showing the configuration and arrangement of a suction opening of the suction device of a valve bag vacuum filling device in a position remote from the filling spout (FIG. 1*a*) and in a position close to the filling spout (FIG. 1*b*)

Referring to the drawings, the valve bag filling device not shown in detail based on the figures involves one whose basic structure corresponds to the Greif-Velox "VELOVAC" machine, i.e., a valve bag vacuum filling device in which the powdered filling material to be filled is conveyed from a supply tank by way of a conveyor line to a filling spout 1, which protrudes at the front side of the machine and is provided to receive a valve hose of a valve bag. The filling process takes place inside of a vacuum chamber 2, which consists of two chamber halves 2*a* and 2*b*, which for purposes of the filling process as shown on FIG. 1*a* have been moved together into a closed vacuum chamber 2, in which is located the filling spout 1 with its free end with a valve hose of a valve bag resting thereupon, which is to be filled with powdered filling material. The structure and function of the machines are basically as known from DE 20 2018 006 418 U1, to which reference is here made in this regard (DE 20 2018 006 418 U1 is hereby incorporated by reference).

The valve bag filling device described here differs from the previously known one in that a suction device is provided for aspirating excess filling material, of which FIG. 1*a* shows a suction hose 3 with an end housing 4, which has a suction opening 5. The suction hose 3 adjoins a suction pump, and has an integrated filter. The suction housing 4 comprises a suction opening and can be moved upwardly and downwardly in a vertical direction 6 in relation to the filling spout 1 by means of a linear drive not shown here in detail. The drive is electric or pneumatic. Two end positions are provided in the exemplary embodiment, specifically the position remote from the spout 7 shown on FIG. 1*a*, in which the suction housing 4 is arranged spaced apart above the vacuum chamber 2, as well as the position close to the spout 8 shown on FIG. 1*b*, in which the housing 4 is in direct proximity to the filling spout 1, specifically arranged at a slight distance above it. This position close to the spout 8 can only be approached if the halves 2*a* and 2*b* of the vacuum chamber 2 are opened, i.e., have been expanded upon conclusion of the filling process, with the suction housing 4 expediently being lowered into the position close to the spout 8 only after the filled valve bag has been removed from the filling spout 1.

Figure 5:
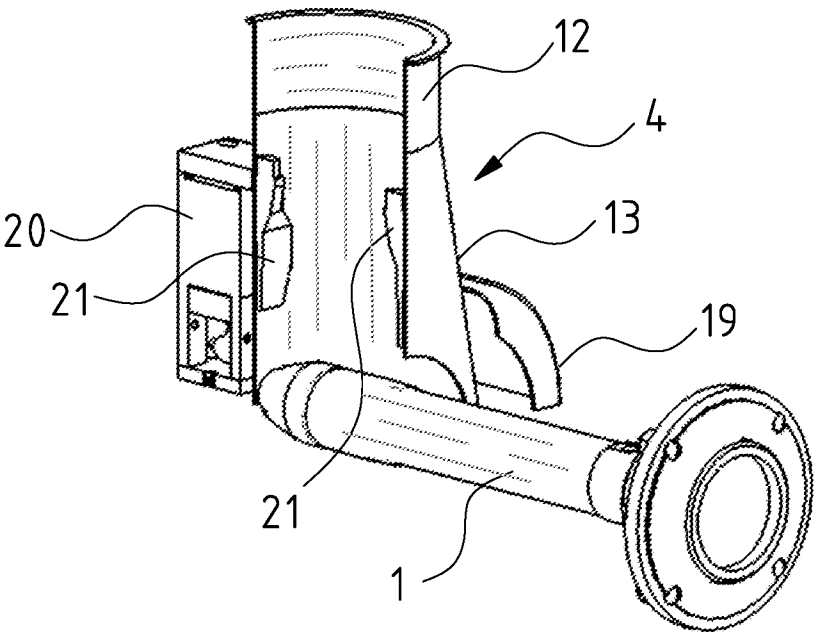
FIG. 5 is a perspective view showing an embodiment variant in a partial section of the view according to FIG. 2.

In the position remote from the spout 7, the suction housing 4 has a distance 9 that is clearly larger than the distance 10 in the position close to the spout 8. The position close to the spout 8 is shown on FIGS. 2, 3 and 5. This position close to the spout 8 is used to aspirate excess filling material located on the filling spout 1 after the filling process.

Figure 2:
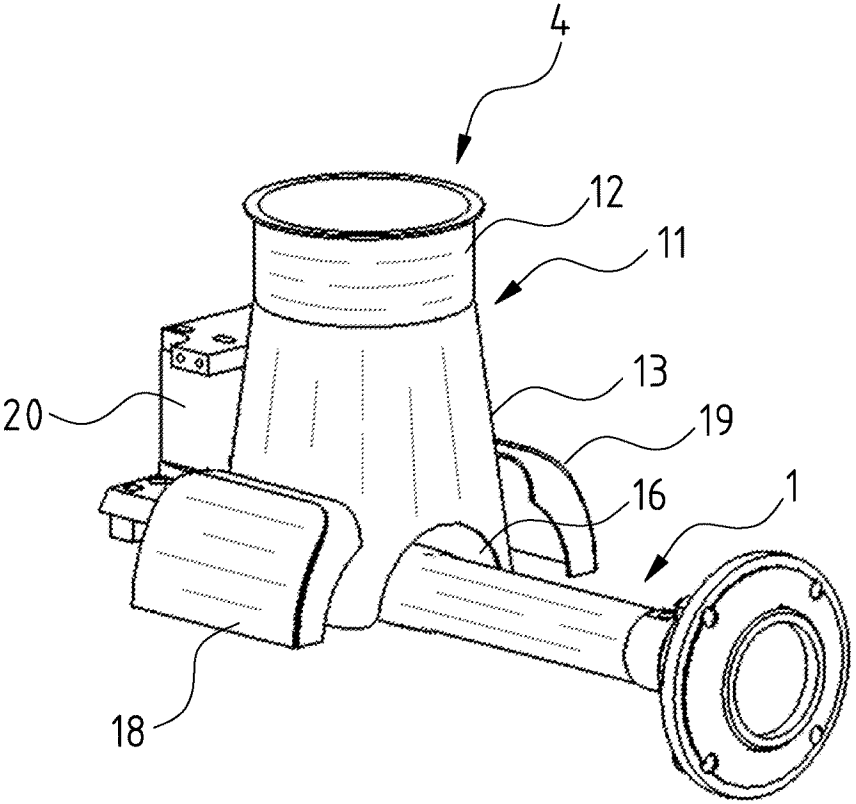
FIG. 2 is a perspective view of a suction nozzle traversed over the filling spout with opened lower housing sections.

The suction housing 4 has a suction nozzle 11, which has an upper cylindrical section 12 to be hooked up to the suction hose 3. The cylindrical section 12 downwardly transitions into a widening section 13, which at its lower end on one side of its shell surface has a semicircular recess 14, which in the position close to the spout 8 has an end section 15 of the filling spout 1 to form a semi-annular gap 16 as part of the suction opening 5. The lower part 17 of the annular gap is formed by the edges of two housing sections 18 and 19, which on FIG. 2 are shown in a folded down position, in which these housing sections 18 and 19 are arranged next to the suction nozzle 11. A mechanism 20 arranged on the rear of the suction nozzle 11, which can be electromagnetically or pneumatically driven, can be used to swivel these housing sections 18 and 19 into the closed position shown on FIG. 3, in which the housing sections 18 and 19 downwardly continue the widening section 13 on its straight sides, and close the housing with the formation of an annular section gap consisting of the semi-annular upper gap 16 and the semi-annular lower gap 17. In this closed position (FIG. 3), the air is aspirated through the annular gap 16, 17 and into the housing 4, which in the widening section 13 tapers upwardly, and in the cylindrical section 12 adjoins the suction hose 3. Since the cross section of the annular gap 16, 17 is distinctly smaller than the remaining cross section of the housing 4, in particular that of the suction hose 3, the air aspirated in this area is accelerated, so that powdered filling material from the filling process that adheres to the filling spout 1 is effectively taken away.

This cleaning effect can be supported by an array of blower nozzles 21 provided internally in the area of the widening section 13, which are hooked up to a compressed air line, and generate a targeted, strong airflow that is directed at the filling spout section 15 and even further enhances the removal of particles adhering to the filling spout section 15. It is here advantageous for one or several pulse-like pressure surges to initially take place through the blower nozzles 21 before or at the same time as the aspiration through the housing 4.

Figure 3:
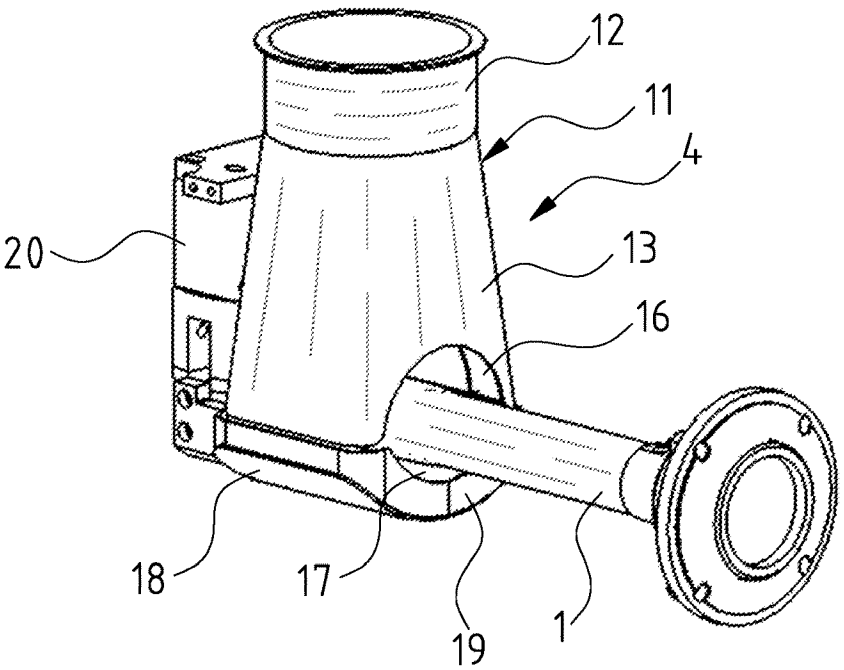
FIG. 3 is the suction nozzle according to FIG. 2 in a closed position of the housing sections.
Figure 4:
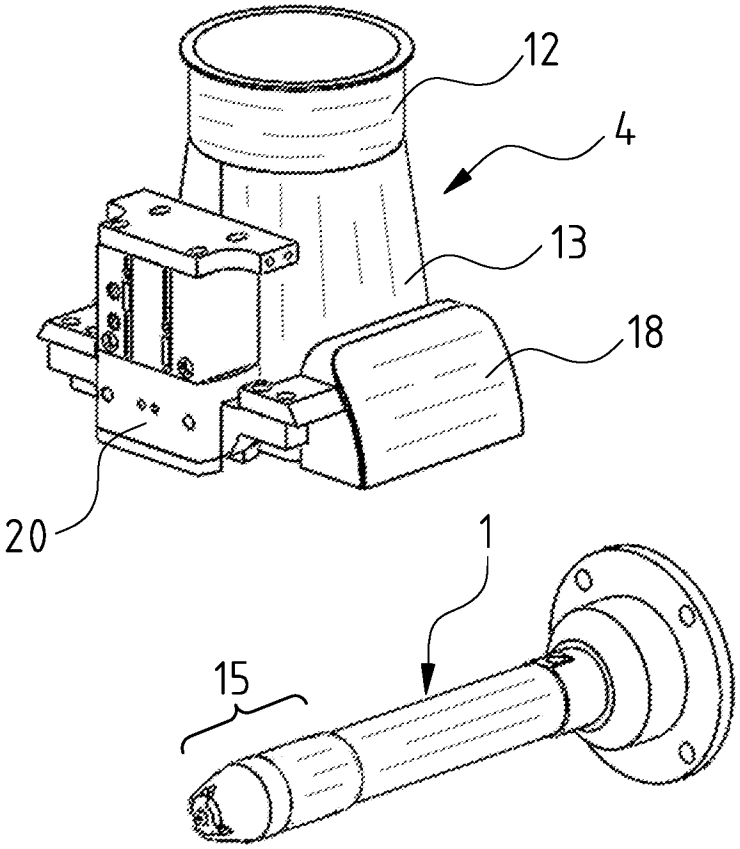
FIG. 4 is the suction nozzle according to FIG. 2 in an opened position from the other side.

The suction device as described above has a control device, which on the one hand provides the drive (actuator) for moving (traversing) the housing 4 out of the position remote from the spout 7 into the position close to the spout 8 and vice versa, and also the drive for the mechanism 20 that moves (traverses) the housing sections 18 and 19 from the folded down position shown on FIGS. 2 and 4 into the folded in position shown on FIG. 3 and vice versa, in which the housing 4 is essentially closed, and only has an annular suction gap 16, 17 formed around the filling spout 1. Further provided is a controller that coordinates the movement of the drives with that of the remaining machine. This controller can be part of the machine controller, or even an external controller, but which is expediently signal-connected with the machine controller or at least recognizes the states relevant for the controller. The controller ensures that the suction housing 4 is only moved from the position remote from the spout 7 into the position close to the spout 8 once the vacuum chamber 2 has been opened, i.e., the left half 2*a* and the right half 2*b* of the vacuum chamber 2 have been moved apart, and the filled valve bag has been removed from the filling spout 1, and hence from the vacuum chamber 2. If the controller has then controlled the drive for moving the suction housing 4 into the position 8 close to the spout 8, the control for actuating the mechanism 20 must then be activated, so that the housing sections 18 and 19 close downwardly to close the suction housing 4, i.e., are arranged under the suction nozzle 11, so that the annular gap 16, 17 is formed to aspirate the filling spout section 15.

At the latest once this position has been reached, the aspiration is activated, and if necessary the compressed air application by the blower nozzles 21, until the cleaning process has ended. A particle sensor can be provided in the exhaust air path for this purpose, which detects the latter. After aspiration is complete, the drive for the mechanism 20 for opening the housing sections 18 and 19 into the position shown on FIGS. 2 and 4 is activated, after which the drive for moving the suction housing 4 up into the position remote from the spout 7 is activated. The machine is thereafter again ready for loading with an empty valve bag and the ensuring filling process.

While specific embodiments of the invention have been shown and described in detail to illustrate the application of the principles of the invention, it will be understood that the invention may be embodied otherwise without departing from such principles.

REFERENCE LIST

1 Filling spout
2 Vacuum chamber
2*a* Left half of the vacuum chamber
2*b* Right half of the vacuum chamber
3 Suction hose
4 Suction housing
5 Suction opening
6 Traversing direction and actuator (drive)
7 Position remote from the spout
8 Position close to the spout
9 Distance to the filling spout in position 7

10 Distance to the filling spout in position 8
11 Suction nozzle
12 Cylindrical section
13 Conical section
14 Semicircular recess
15 End section
16 Semicircular gap, above
17 Semicircular gap, below
18 Housing section
19 Housing section
20 Mechanism
21 Blower nozzles

What is claimed is:

1. A valve bag filling device for filling powdered filling material into a valve bag, the valve bag filling device comprising:

a filling spout configured so as to be introduced into a valve hose of a valve bag to be filled;

a conveying device for conveying the filling material to be filled from a supply tank through the filling spout into a valve bag resting on the filling spout with a valve hose;

a suction device for aspirating excess filling material with a suction opening arranged spaced a distance from the filling spout; and a control device configured to traverse the suction opening in relation to the filling spout, wherein the suction opening in a position close to the filling spout comprises an annular suction opening that extends annularly around a section of the filling spout.

2. The valve bag filling device according to claim 1, wherein the control device has a controller, which forms part of a machine controller of the valve bag filling device, or is signal-connected with the latter, such that the position close to the spout is only approached after the valve hose has been removed from the filling spout or once the filling process has ended.

3. The valve bag filling device according to claim 1, further comprising blower nozzles of a compressed gas carrying line wherein the suction opening forms an end of a suction line, and that blower nozzles of the compressed gas carrying line are directed toward the filling spout and are arranged before the suction opening inside of the suction line.

4. The valve bag filling device according to claim 1, wherein the control device comprises an actuator, with which the suction opening is traversed from the position close to the filling spout to a position remote from the filling spout and vice versa.

5. The valve bag filling device according to claim 4, wherein the actuator has a manipulator.

6. The valve bag filling device according to claim 4, further comprising a vacuum chamber, wherein the suction opening is arranged outside of the vacuum chamber in the position remote from the spout, and the suction opening is arranged inside of the opened vacuum chamber in the position close to the spout.

7. The valve bag filling device according to claim 1, wherein the annular suction opening bordered by an annular housing opens toward the filling spout.

8. The valve bag filling device according to claim 7, wherein the annular housing comprises two movable housing parts.

9. The valve bag filling device according to claim 7, wherein the annular housing comprises a movable housing part.

10. The valve bag filling device according to claim 9, further comprising at least one drive coupled with the movable housing part for moving the movable housing part.

11. The valve bag filling device according to claim 7, wherein the suction line has an end side suction nozzle, which forms an upper portion of the annular housing open toward the filling spout, wherein a lower portion of the annular housing comprises a movable housing part moveable between an open position with the movable housing part arranged next to the suction nozzle and a closed position with the movable housing part arranged under the suction nozzle.

12. The valve bag filling device according to claim 7, wherein a controller is provided, which traverses the at least one movable housing part upon reaching the position close to the filling spout to include the filling spout under the suction nozzle nozzles, and traverses back again once aspiration is complete.

13. A valve bag filling device for filling powdered filling material into a valve bag, the valve bag filling device comprising:

a filling spout configured so as to be introduced into a valve hose of a valve bag to be filled;

a conveying device for conveying the filling material to be filled from a supply tank through the filling spout into a valve bag resting on the filling spout with a valve hose;

a suction device for aspirating excess filling material with a suction opening arranged spaced a distance from the filling spout;

a control device configured to traverse the suction opening in relation to the filling spout; and a vacuum chamber, wherein the suction opening is arranged outside of the vacuum chamber in the position remote from the spout, and the suction opening is arranged inside of the opened vacuum chamber in the position close to the spout, wherein the control device comprises an actuator, with which the suction opening is traversed from a position close to the filling spout to a position remote from the filling spout and vice versa.

14. The valve bag filling device according to claim 13, wherein the control device has a controller, which forms part of a machine controller of the valve bag filling device, or is signal-connected with the latter, such that the position close to the spout is only approached after the valve hose has been removed from the filling spout or once the filling process has ended.

15. The valve bag filling device according to claim 13, further comprising blower nozzles of a compressed gas carrying line wherein the suction opening forms an end of a suction line, and that blower nozzles of the compressed gas carrying line are directed toward the filling spout and are arranged before the suction opening inside of the suction line.

16. The valve bag filling device according to claim 13, wherein the annular suction opening bordered by an annular housing opens toward the filling spout.

17. The valve bag filling device according to claim 16, wherein the annular housing comprises a movable housing part.

18. A valve bag filling device for filling powdered filling material into a valve bag, the valve bag filling device comprising:

a filling spout configured so as to be introduced into a valve hose of a valve bag to be filled;

a conveying device for conveying the filling material to be filled from a supply tank through the filling spout into a valve bag resting on the filling spout with a valve hose;

a suction device for aspirating excess filling material with a suction opening arranged spaced a distance from the filling spout;

a control device configured to traverse the suction opening in relation to the filling spout; and a blower nozzles of a compressed gas carrying line wherein the suction opening forms an end of a suction line, and that blower nozzles of the compressed gas carrying line are directed toward the filling spout and are arranged before the suction opening inside of the suction line.

19. The valve bag filling device according to claim 18, wherein the control device has a controller, which forms part of a machine controller of the valve bag filling device, or is signal-connected with the latter, such that the position close to the spout is only approached after the valve hose has been removed from the filling spout or once the filling process has ended.

20. The valve bag filling device according to claim 19, further comprising a vacuum chamber, wherein the suction opening is arranged outside of the vacuum chamber in the position remote from the spout, and the suction opening is arranged inside of the opened vacuum chamber in the position close to the spout.

* * * * *